US006527579B2

(12) United States Patent
Sato et al.

(10) Patent No.: US 6,527,579 B2
(45) **Date of Patent: *Mar. 4, 2003**

(54) CONNECTOR-SHAKING PREVENTION STRUCTURE

(75) Inventors: Naotoshi Sato, Shizuoka (JP); Masaya Yamamoto, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/556,843

(22) Filed: Apr. 21, 2000

(65) Prior Publication Data

US 2002/0064989 A1 May 30, 2002

(30) Foreign Application Priority Data

Apr. 27, 1999 (JP) ..... 11-119389

(51) Int. Cl.[7] ..... H01R 4/38; H01R 13/648

(52) U.S. Cl. ..... 439/382; 439/352

(58) Field of Search ..... 439/382, 352, 439/353, 354, 357, 489

(56) References Cited

U.S. PATENT DOCUMENTS 3,680,033 A * 7/1972 Kawai ..... 439/352
5,591,041 A * 1/1997 Cecil, Jr. et al. ..... 439/352
6,123,575 A * 9/2000 Huang et al. ..... 439/489
6,126,480 A * 10/2000 Kawase et al. ..... 439/489

FOREIGN PATENT DOCUMENTS

JP 62-53583 4/1987 ..... H01R/13/533

* cited by examiner

*Primary Examiner*—Lynn D. Feild
*Assistant Examiner*—Brian S. Webb
(74) *Attorney, Agent, or Firm*—Sughrue Mion, PLLC

(57) ABSTRACT

An elastic arm (2), having a shaking prevention projection (3), is formed on one connector (1), and a recess (5) for fitting engagement with the projection (3) is formed in the other connector (4). When the two connectors (1, 4) are completely fitted together, the projection (3) is engaged in the recess (5) in such a manner that front and rear surfaces (3*a*, 3*b*) of the projection (3) are held in intimate contact with front and rear surfaces (5*a*, 5*b*) of the recess (5), respectively. These surfaces (3*a*, 3*b*, 5*a*, 5*b*) are slanting. When the projection (3) is engaged in the recess (5), elastic deformation of the arm (2) is canceled. The arm (2) extends straight along a connector fitting chamber (6), and the recess (5) is formed in an outer wall (45) of the connector (4). A lock mechanism (12, 27) for locking the two connectors to each other are provided generally in opposed relation to the arm (2). Second and third arms (31, 32) for shaking prevention purposes are provided 90° out of phase with the arm (2) in opposite directions. Preferably, the second and third arms (31, 32) are disposed flush with opposite side walls (30) of the connector (1), respectively, and each of the second and third arms has a projection (34; 35) which projects from the corresponding side wall (30).

15 Claims, 7 Drawing Sheets

CONNECTOR-SHAKING PREVENTION STRUCTURE

BACKGROUND OF THE INVENTION

1. Field of the Invention

The present invention relates to a connector-shaking prevention structure in which a relative movement (shaking movement) between male and female connectors, fitted together, in connector fitting and disengaging directions is prevented by engaging an arm in a recess.

The present application is based on Japanese Patent Application No. Hei. 11-119389, which is incorporated herein by reference.

2. Description of the Related Art

FIGS. 9 and 10 show a conventional connector-shaking prevention structure disclosed in Unexamined Japanese Utility Model Publication No. Sho. 62-53583.

In this structure, elastic arms 67 are integrally formed respectively on three side walls of a casing 66 (made of a synthetic resin) for receiving a connector 65 (FIG. 10) therein, and the arms 67 are pressed respectively against three outer side surface 68 of the connector 65 within the casing 66, thereby preventing the shaking movement of the connector 65 in a direction perpendicular to the direction of insertion of this connector.

Each of the arms 67 projects inwardly from the associated wall 69 of the casing 66 in an inclined manner, and is in the form of a flat rectangular plate, and is pressed at its distal end or edge 67*a* against the outer surface 68 of the connector 65. Two of the three arms 67 are opposed to each other, and guide ribs 70 are formed on that inner surface of the casing 66 opposed to the other (intermediate) arm 67. A guide plate 71 extends from the ribs 70 in a direction opposite to the direction of projecting of the arms 67, and is disposed outwardly of the casing 66. A retaining projection 72 for the connector 65 is formed on the guide plate 71.

As shown in FIG. 10, the connector 65 is inserted into the casing 66 along the guide plate 71, and a lock arm 73, formed on a rear end portion of the connector 65, is engaged with the retaining projection 72, thereby preventing the connector 65 from withdrawal from the casing 66. Within the casing 66, the connector 65 is pressed inwardly by the arms 67 (FIG. 9), and therefore is prevented from shaking movement within the casing 66. The connector 65 is of the female type having male terminals (not shown) mounted in a connector fitting chamber 74, and when a mating connector 75 of the male type, having female terminals (not shown), is inserted into the connector fitting chamber 74, the male terminals are connected to the female terminals, respectively.

In the above conventional structure, however, in order to positively prevent the shaking movement of the connector 65, the amount of displacement of the arms 67 is set to a large value so as to provide a sufficient load to hold the connector 65. Therefore, a large stress always acts on each arm 67, and therefore the arms 67 are liable to experience permanent deformation, and in such a case the pressing force is much reduced, which has resulted in a problem that the connector 65 is liable to make a shaking movement. And besides, in the conventional structure, although the shaking movement of the connector 65 relative to the casing 66 may be prevented, there has not been provided any means for preventing a relative shaking movement between the two connectors 65 and 75, and particularly the male connector 75 moves forward and backward (in the fitting and disengaging directions) relative to the female connector 65. This has invited problems that abnormal noises are produced, that the male and female terminals, fitted together, are worn, and that the connector housings of a synthetic resin, connected together, are worn.

SUMMARY OF THE INVENTION

With the above problems in view, it is an object of the present invention to provide a connector-shaking prevention structure in which a relative movement (shaking movement) between male and female connectors in connector fitting and disengaging directions is positively prevented, and besides a shaking prevention arm will not be subjected to permanent deformation, so that such shaking movement is positively prevented for a long period of time.

To achieve the above object, according to the first aspect of the present invention, there is provided a connector which comprises a first connector housing, a second connector housing fittable to the first connector housing, an elastic arm formed in the first connector housing so as to extend along a substantially fitting direction of the first and second connector housings, the elastic arm having a shaking prevention projection which is formed on a front end of the elastic arm, and has front and rear surfaces, and a recess formed in the second connector housing, and having front and rear inner surfaces, wherein when the first and second connector housings are completely fitted together, the shaking prevention projection is engaged in the recess so that the front and rear surfaces of the shaking prevention projection are held in intimate contact with the front and rear inner surfaces of the recess, respectively.

According to the second aspect of the present invention, it is preferable that the front and rear inner surfaces of the recess, and the front and rear surfaces of the shaking prevention projection, are slanting surfaces.

According to the third aspect of the present invention, it is preferable that when the shaking prevention projection is engaged in the recess, elastic deformation of the elastic arm is canceled.

According to the fourth aspect of the present invention, it is preferable that the elastic arm has a surface extending straight along a connector fitting chamber which is formed in the first connector housing, and into which the second connector housing is insertable, and the recess is formed in an outer wall of the second connector housing.

According to the fifth aspect of the present invention, it is preferable that the surface of the elastic arm is flush with at least one of inner surfaces of the connector fitting chamber, and the shaking prevention projection projects beyond a level of the at least one of inner surfaces into the connector fitting chamber.

According to the sixth aspect of the present invention, it is preferable that the connector further comprises a lock mechanism provided substantially in opposed relation to the elastic arm, and maintaining a completely fitted condition of the first and second connector housings.

According to the seventh aspect of the present invention, it is preferable that the connector further comprises second and third shaking prevention arms which are provided 90° out of phase with the elastic arm in opposite directions.

According to the eighth aspect of the present invention, it is preferable that the second and third shaking prevention arms have surfaces which are respectively flush with surfaces of opposite side outer walls of the first connector housing, and projections respectively formed on the second and third arms so as to project in the connector fitting chamber.

DETAILED DESCRIPTION OF THE PREFERRED EMBODIMENTS

A preferred embodiment of the present invention will now be described in detail with reference to the drawings.

FIGS. 1 to 5 show a first embodiment of a connector-shaking prevention structure of the present invention.

Figure 1:
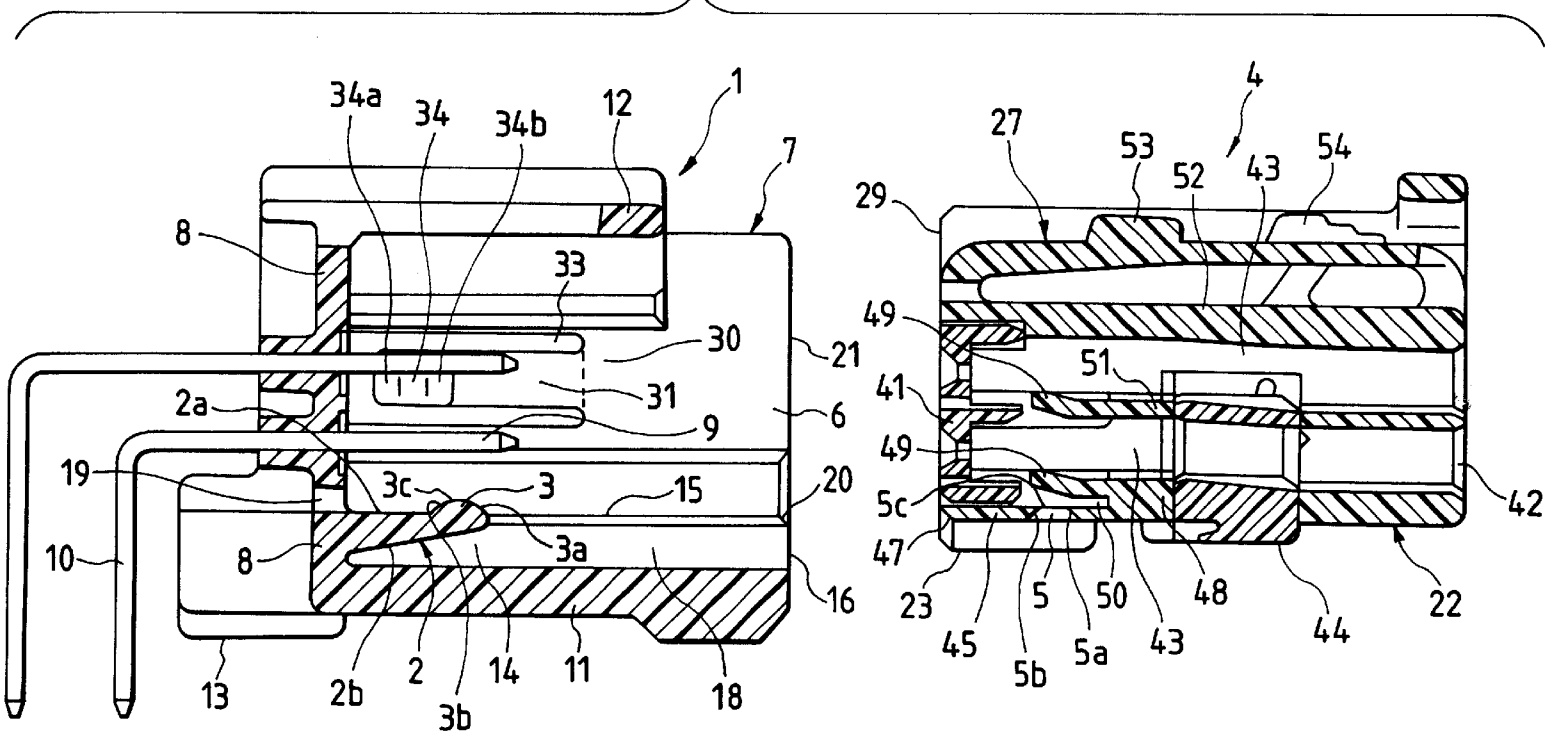
FIG. 1 is a vertical cross-sectional view of a first embodiment of a connector-shaking prevention structure of the present invention.

As shown in FIG. 1, this structure is characterized in that a first shaking-prevention arm 2 (hereinafter referred to as "arm") of an elastic nature is formed on a female connector 1, and projects in a connector fitting direction and that a recess 5, in which a projection 3 of the arm 2 can be engaged, is formed in a male connector 4. In this specification, that connector, having a connector fitting chamber 6, is defined as the female connector 1 whereas that connector for fitting into the connector fitting chamber 6 is defined as the male connector 4.

The female connector 1 comprises a female connector housing 7 of a synthetic resin, and male terminals 9 extending through a vertical proximal end wall 8 of the connector housing 7 and projecting horizontally into the connector fitting chamber 6. Each male terminal 9 is continuous with a bus bar 10, and the bus bar 10 is bent perpendicularly, and is soldered at its distal end, for example, to a circuit board (not shown) of an equipment.

The connector housing 7 includes the vertical proximal end wall 8, a horizontal outer wall portion 11, provided at a lower side of the connector fitting chamber 6 so as to be held in contact with the equipment, and a lock wall portion 12 provided horizontally at an upper side of the connector fitting chamber 6. A mounting portion 13 for mounting on the equipment is provided at a rear side of the proximal end wall 8.

The arm 2 is formed integrally with and extends horizontally from the proximal end wall 8 along the axis of the connector fitting chamber 6, and is disposed adjacent to the outer wall portion 11 in parallel relation thereto. A flexure space 14 for receiving the arm 2 is formed between the arm 2 and the outer wall portion 11. An upper surface 2*a* of the arm 2 is disposed flush with an inner surface 15 of the connector fitting chamber 6. This inner surface 15 serves as an inner surface of a lower wall 16 (FIG. 2), and the arm 2 is separated from the wall 16 by a slit (not shown) formed around the periphery of the arm 2. The shaking prevention projection 3 is formed integrally on the upper surface 2*a* of the arm 2 at the distal end thereof, and is directed upwardly. The projection 3 has tapering slanting surfaces 3*a* and 3*b*, formed respectively at its front and rear sides in the connector fitting direction, and also has an apex surface 3*c* formed between the slanting surfaces 3*a* and 3*b*. The projection 3 projects beyond the inner surface 15 into the connector fitting chamber 6.

A lower surface 2*b* of the arm 2 is slightly slanting downwardly from the distal end thereof to the proximal end wall 8, and the thickness of the arm 2 is increasing progressively toward the proximal end thereof so that the arm 2 can produce a restoring force directed upwardly (toward the inside of the connector fitting chamber 6). The flexure space 14 for the arm 2 assumes a wedge-like shape. The length of the arm 2 is slightly smaller than the length of projecting of the terminals 9, and is about ⅓ of the length of the connector fitting chamber 6.

Figure 2:
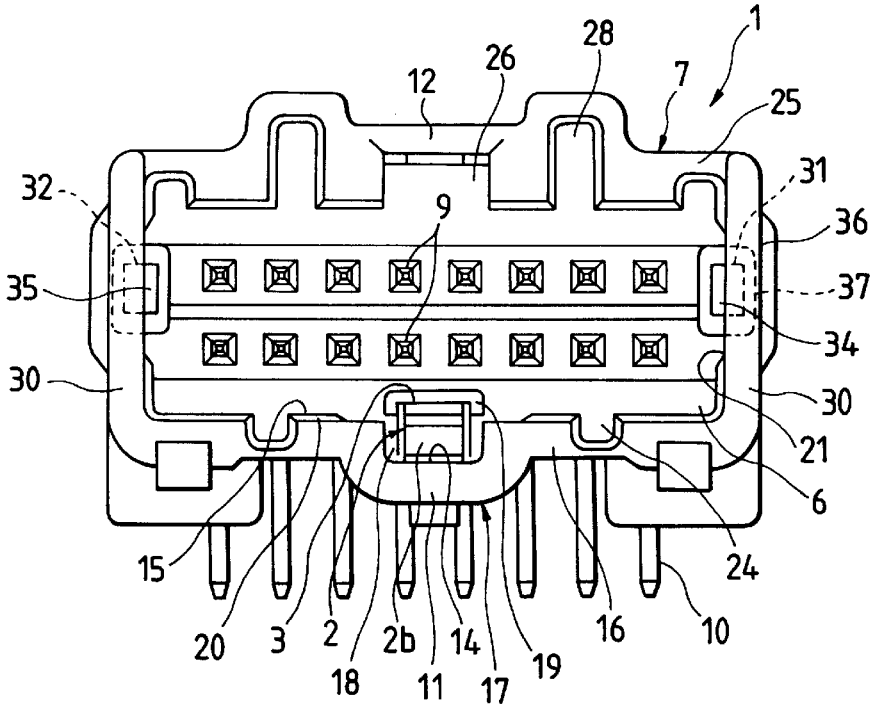
FIG. 2 is a front-elevational view of a female connector.

As shown in FIG. 2, the plurality of juxtaposed male terminals 9 are arranged in two (upper and lower) rows within the connector fitting chamber 6, and each terminal 9 is continuous with the bus bar 10. The outer wall portion 11 is formed at a widthwise-central portion of the lower wall 16, forming the connector fitting chamber 6, and bulges outwardly. A wall 17 of a U-shaped cross-section is formed by the outer wall portion 11 and those portions of the wall 16 disposed respectively on opposite sides of the wall 17, and the arm 2 is elastically-deformably disposed in an internal space (channel-shaped groove) 18 of the U-shaped wall 17. The projection 3 at the distal end of the arm 2 projects upwardly beyond the inner surface 15 into the connector fitting chamber 6. The lower surface 2*b* of the arm 2 is slanting downwardly within the channel-shaped groove 18. The wedge-like flexure space 14 is formed between the inner surface of the channel-shaped groove 18 and the lower surface 2*b* of the arm 2.

In FIGS. 1 and 2, reference numeral 19 denotes a molding hole formed in the proximal end wall 8 for molding the projection 3. Chamfered guide surface 20 is formed at a front opening 21 of the connector fitting chamber 6. In FIG. 2, a pair of guide grooves 24 are formed on opposite (right and left) sides of the channel-shaped groove 18, respectively, and elongate projections 23 (FIG. 1), formed on a mating male connector housing 22, can be engaged in these guide grooves 24, respectively.

In FIG. 2, the lock wall portion (lock mechanism) 12 is provided at a widthwise-central portion of an upper wall 25 of the connector fitting chamber 6. The lock wall portion 12 is disposed generally in opposed relation to the arm 2. A channel-shaped groove 26 is formed at the inner side of the lock wall portion 12, and a lock arm 27 (FIG. 1) on the mating male connector housing 22 can be inserted into the channel-shaped groove 26. Reference numeral 28 denotes guide grooves for respectively receiving vertical positioning plates 29 (FIG. 3) on the male connector housing 22.

The lower wall 16 is continuous and integral with opposite (right and left) side walls 30 of the connector fitting chamber 6. The right and left walls 30 define opposite inner side surfaces of the connector fitting chamber 6, respectively. Second and third shaking-prevention arms (hereinafter referred to as "arms") 31 and 32 are formed respectively on the right and left side walls 30 in opposed relation to each other, and are disposed centrally of the height of the connector fitting chamber 6. As shown in FIG. 1, each of the arms 31 and 32 extends straight rearwardly (in a connector disengaging direction) from a generally lengthwise-central portion of the corresponding wall 30. A generally U-shaped notch 33 is formed in each wall 30 at upper, lower and front sides of the corresponding arm 31, 32 (FIG. 2).

The arms 31 and 32 are provided 90° out of phase with the arm 2 in opposite directions.

Shaking prevention projections 34 and 35 are formed integrally on distal ends of the arms 31 and 32, respectively, and these projections 34 and 35 are disposed in the vicinity of the proximal end wall 8, and project into the connector fitting chamber 6. The arms 31 and 32 are formed integrally with the opposite side walls 30, respectively, and the inner surfaces of the arms 31 and 32 are disposed flush with the inner surfaces of the opposite side walls 30, respectively. Each of the projections 34 and 35 has tapering slanting surfaces 34*a* and 34*b* (see FIG. 1, but the showing of the slanting surfaces of the projection 35 is omitted), formed respectively at its front and rear sides.

As shown in FIG. 2, outer walls 36 are formed respectively on the opposite side walls 30 in a bulged manner, and are disposed outwardly of the second and third arms 31 and 32, respectively. A flexure space 37 for receiving the corresponding arm is formed between the outer surface of each of the arms 31 and 32 and the inner surface of the corresponding outer wall 30. A gap dimension of the flexure space 37 is substantially equal to the amount of projecting of the projection 34, 35. Only the projection 34, 35 projects from the inner surface of the corresponding wall 30 into the connector fitting chamber 6. Like the projection 3 of the first arm 2, the projections 34 and 35 of the second and third arms 31 and 32 can be engaged respectively in recesses 38 and 39 (FIG. 4) in the mating male connector housing 22. Alternatively, the recesses 38 and 39 (FIG. 4) may not be provided, in which case the projections 34 and 35 of the second and third arms 31 and 32 are adapted to be pressed respectively against flat opposite side surfaces 40 of the mating male connector housing 22.

As shown in FIG. 1, the male connector 4 comprises the male connector housing 22 of a synthetic resin, a front holder 41 of a synthetic resin, attached to a front end of the connector housing 22, female terminals 60 (FIG. 5) inserted respectively into terminal receiving chambers 43 through a rear opening 42 in the connector housing 22, and a terminal double-retaining spacer 44 attached to a lengthwise-central portion of the connector housing 22 in a direction perpendicular to the connector fitting direction.

The engagement recess 5 for receiving the projection 3 of the first arm 2 is formed in a lower outer wall 45, and is disposed adjacent to the front end of the connector housing 22. The recess 5 has slanting surfaces 5*a* and 5*b* formed respectively at its rear and front sides, and these slanting surfaces 5*a* and 5*b* has the same inclination angle as that of the front and rear slanting surfaces 3*a* and 3*b* of the projection 3. The recess 5 extends at its central portion through the thin outer wall 45, and the projection 3 can be snugly fitted in the recess 5, with the apex surface 3*c* disposed at this through hole portion 5*c*. In this embodiment, the recess 5 is a through hole having the tapering front and rear surfaces. The recess 5 may be a hole of a channel-shaped cross-section or a blind hole. A slanting guide surface 47 for sliding contact with the front slanting surface 3*a* of the projection 3 of the arm 2 is formed at a front end of the outer wall 45.

A thick wall 48 is formed integrally with and extends from a rear end of the thin outer wall 45, and elastic terminal-retaining lances 49 are formed integrally with this wall 48, and are disposed in the lower row of terminal receiving chambers 43, respectively, the retaining lances 49 projecting forwardly. A flexure space 50 is formed between each of these retaining lances 49 and the outer wall 45. Retaining lances 49 are formed integrally with a partition wall 51, separating the upper row of terminal receiving chambers 43 from the lower row of terminal receiving chambers 43, and are disposed in the upper row of terminal receiving chambers 43, respectively.

The lock arm (lock mechanism) 27 is integrally formed and supported at its opposite ends on an upper wall 52 on the upper side of the upper row of terminal receiving chambers 43. A lock projection 53 for engagement with the lock wall portion 12 is formed on a front portion of the lock arm 27. Reference numeral 54 denotes an operating projection for canceling a locked condition.

Figure 3:
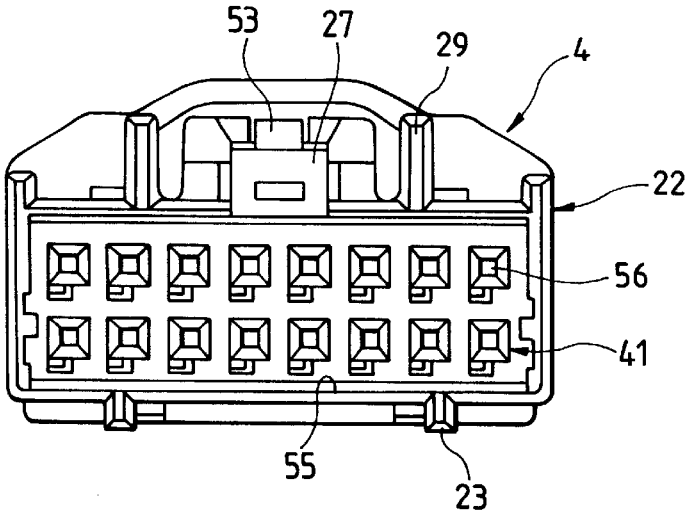
FIG. 3 is a front-elevational view of a male connector housing.

As shown in FIG. 3, the front holder 41 is fitted in a front opening 55 in the male connector housing 22 to form a front end wall of the male connector 4. Insertion holes 56 for respectively passing the male terminals 9 of the mating female connector 1 (FIG. 1) therethrough are formed through the front holder 41.

Figure 4:
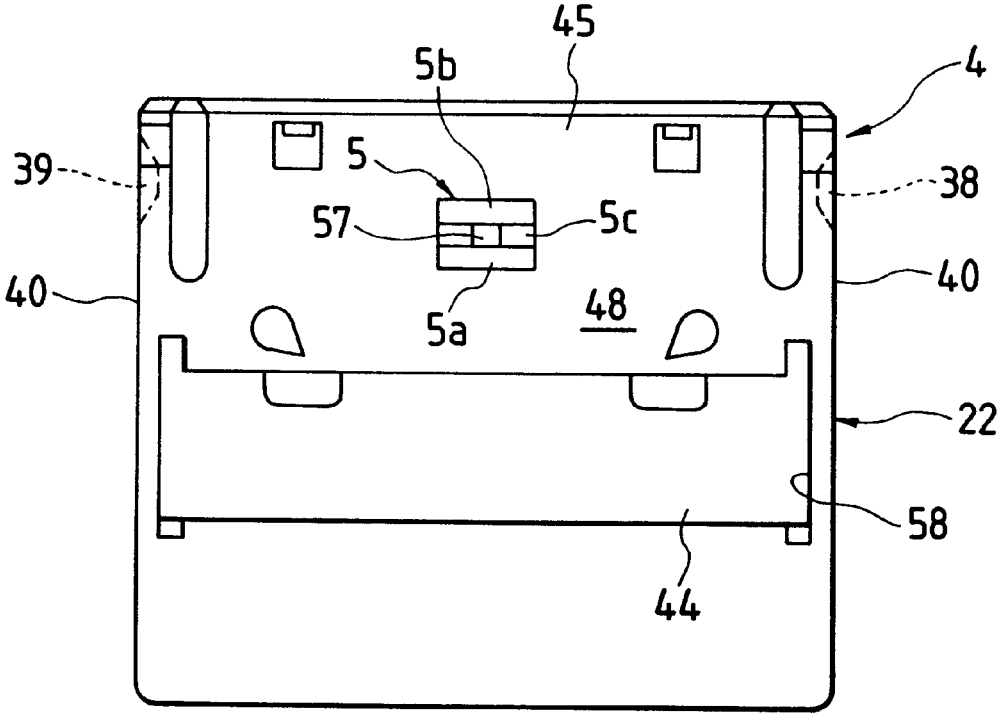
FIG. 4 is a bottom view of the male connector housing.

As shown in FIG. 4, the engagement recess 5 for receiving the projection 3 of the first arm 2 is formed in a widthwise-central portion of the lower outer wall 45, and is disposed adjacent to the front end of the male connector housing 22. The recess 5 has the front and rear slanting surfaces 5*a* and 5*b*, and the through hole portion 5*c* at its central portion. A partition wall 57, separating the juxtaposed (right and left) terminal receiving chambers 43 (FIG. 1) from each other, is disposed at the inner side of the through hole portion 5*c*. The terminal double-retaining spacer 44 is inserted in an opening 58 formed through the thick wall 48 extending from the outer wall 45.

The engagement recesses 38 and 39 for respectively receiving the projections 34 and 35 of the second and third arms 31 and 32 (FIG. 2) are formed respectively in the opposite side surfaces 40 of the male connector housing 22 at the front end portion thereof. As described above, the recesses 38 and 39 may not be provided, in which case the projections 34 and 35 of the second and third arms 31 and 32 are adapted to be pressed respectively against the opposite side surfaces 40. In this case, when the two connectors are completely fitted together, the arms 31 and 32 are slightly flexed.

Figure 5:
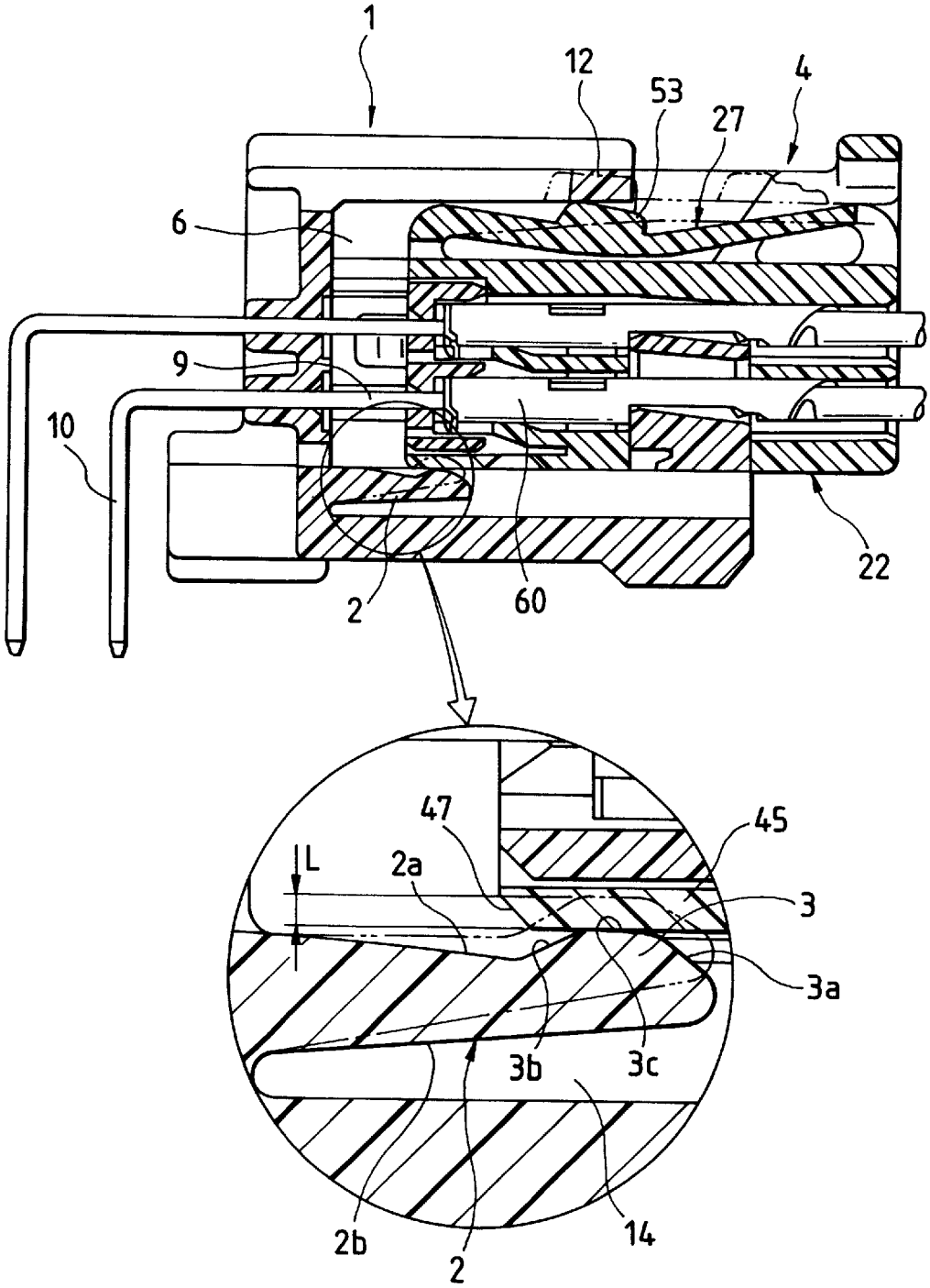
FIG. 5 is a vertical cross-sectional view showing the process of fitting the two connectors together.

In the process of fitting the two connectors 1 and 4 together as shown in FIG. 5, the front slanting surface 3*a* of the projection 3 of the first arm 2 smoothly slides on the slanting guide surface 47 at the front end of the male connector housing 22, so that the arm 2 is flexed (elastically deformed) downwardly toward the flexure space 14 in an amount L, and then the apex surface 3*c* of the projection 3 smoothly slides on the outer wall 45. The upper surface 2*a* of the arm 2 is displaced from its initial horizontal condition into a slanting condition whereas the lower surface 2*b* of the arm 2 is displaced from its initial upwardly-slanting condition into a generally horizontal condition. The arm 2 has an upwardly-restoring force (resilient force).

In the condition of FIG. 5, the male terminals 9 are inserted into the female terminals 60, respectively, and also the lock projection 53 of the lock arm 27 is pressed against the lock wall portion 12, and the lock arm 27 is flexed downwardly, so that the lock projection 53 advances in sliding contact with the lower surface of the lock wall portion 12.

When the two connectors 1 and 4 are completely fitted together, the lock arm 27 is restored, so that the lock projection 53 engages the front side of the lock wall portion 12. At the same time, the arm 2 is restored, the projection 3 of the arm 2 is engaged in the recess 5 in the outer wall 45 of the connector housing 22. Thus, the arm 2 is restored into its initial condition before the fitting of the connector, that is, in a horizontally-projecting, non-flexed condition.

The arm 2 is disposed parallel to the outer wall 45 of the connector housing 22, and a small gap is formed between the outer wall 45 and the upper surface 2*a* of the arm 2, or the upper surface 2*a* of the arm 2 contacts the outer wall 45 under a low pressure. The projection 3 is snugly fitted in the recess 5. More specifically, the front slanting surface 3*a* of the projection 3 is held in contact with the rear slanting surface 5*a* of the recess 5 while the rear slanting surface 3*b* of the projection 3 is held in contact with the front slanting surface 5*b* of the recess 5. As a result, the male connector 1 is retained relative to the female connector 4 against shaking movement in the forward-rearward direction, that is, in the fitting and disengaging directions.

Like the first arm 2, the second and third arms 31 and 32 (FIG. 2) are disposed parallel to the opposite (right and left) side surfaces 40 (FIG. 4) of the connector housing 22, respectively, and the projections 34 and 35 of these arms 31 and 32 are engaged respectively in the recesses 38 and 39 formed respectively in the opposite side surfaces 40. Therefore, the shaking movement of the female connector 4 relative to the female connector 1 in the right-left direction (perpendicular to the connector fitting direction) is prevented, and besides the shaking movement in the forward-rearward direction (connector fitting and disengaging directions) is more positively prevented. During the connector fitting operation, the rear slanting surface 34*b* (see FIG. 1, but the showing of the slanting surfaces of the projection 35 of FIG. 2 is omitted) of the projection 34, 35 of each of the arms 31 and 32 smoothly slides on the front end of the male connector housing 22.

In the case where the recesses 38 and 39 are not provided respectively in the opposite side surfaces 40 of the connector housing 22, and instead the projections 34 and 35 of the second and third arms 31 and 32 are pressed respectively against the opposite side surfaces 40, the shaking movement of the male connector 4 relative to the female connector 1 in the right-left direction is prevented. In this case, also, the shaking movement in the forward-rearward direction is positively prevented by the first arm 2.

The first arm 2 in a non-flexed condition (that is, in its initial condition) is engaged in the recess 5 in the male connector housing 22, and therefore the resilient force of the arm 2 will not be subjected to aged deterioration, and the shaking movement of the two connectors 1 and 4 relative to each other in the forward-rearward direction can be positively prevented for a long period of time. And besides, even if the spring force of the arm 2 is weak, the shaking movement can be positively prevented, and therefore the thickness of the arm 2 can be reduced, and the amount of flexing of the arm 2 can be decreased, and therefore a compact design in a direction perpendicular to the connector fitting direction can be achieved. These effects are also achieved with the second and third arms 31 and 32.

Figure 6:
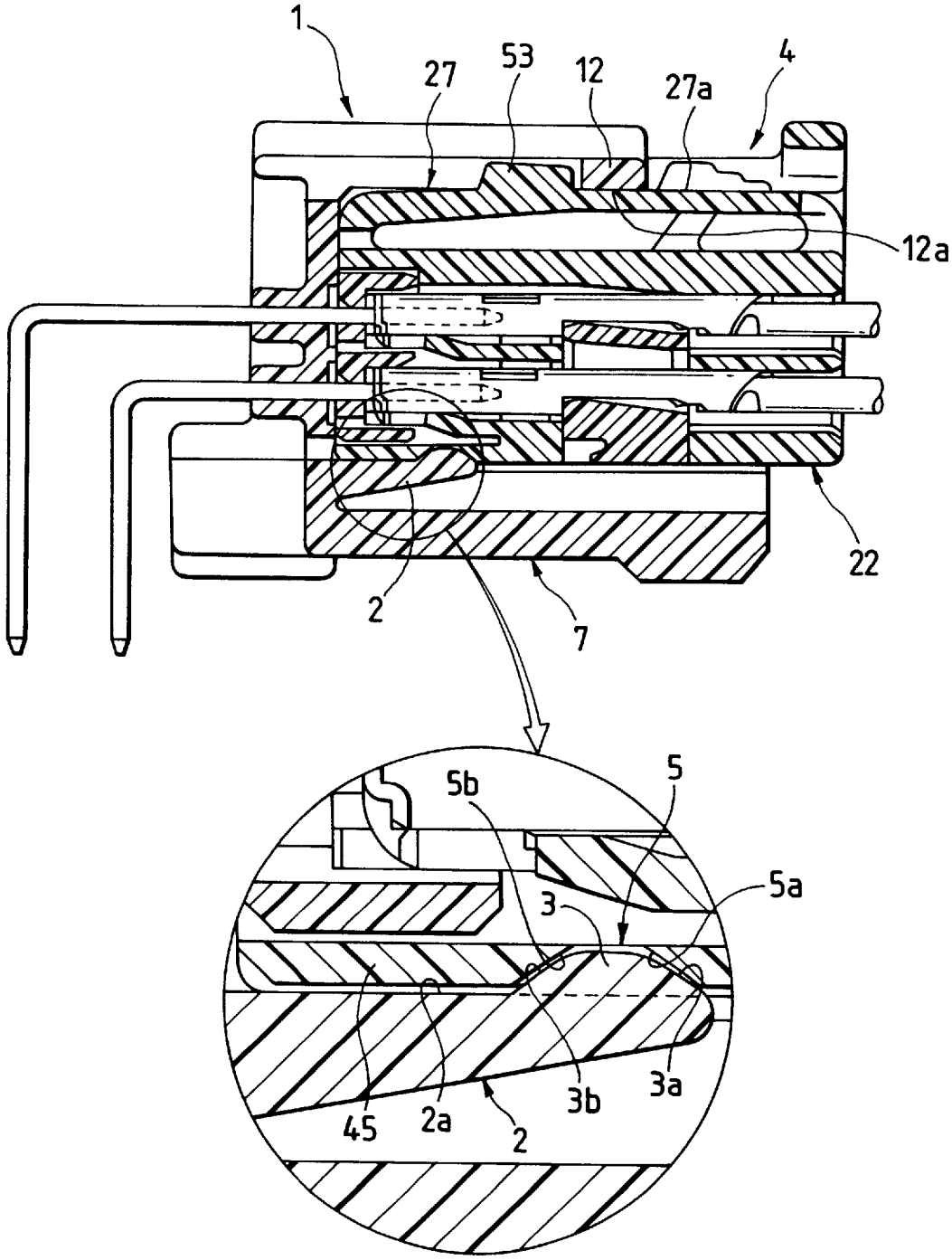
FIG. 6 is a vertical cross-sectional view showing the two connectors in a completely-fitted condition.

With respect to the connector-fitted condition of FIG. 6, the lock projection 53 of the lock arm 27 slides past the lock wall portion 12 of the female connector housing 7, so that an upper surface 27*a* of the lock arm 27 is pressed against an inner surface 12*a* of the lock wall portion 12, and the first arm 2 is disposed generally in vertically-spaced, opposed relation to the lock arm 27. Therefore, the shaking movement in the vertical direction (upward-downward direction) is positively prevented by the lock arm 27 and the first arm 2. The rearward withdrawal of the male connector is prevented by the lock arm 27.

In the connector-fitted condition of FIG. 6, the lock arm 27 is pressed to be flexed downwardly, and in this condition the male connector 4 is pulled rearwardly, and as a result the rear slanting surface 3*b* of the projection 3 of the first arm 2 smoothly slides on the front slanting surface 5*b* of the recess 5, so that the arm 2 is flexed in a retainment-canceling direction, and the male connector 4 is smoothly disengaged from the female connector 1. Similarly, the sliding movement of the rear slanting surface 34*b* of each of the second and third arms 31 and 32 on the front slanting surface of the corresponding recess 38, 39, as well as the retainment-canceling operation of the second and third arms 31 and 32, is effected smoothly.

Figure 7:
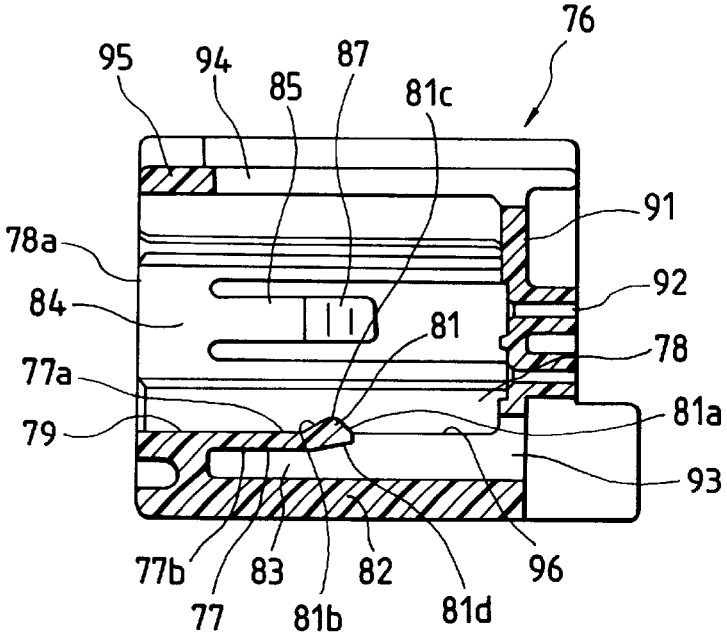
FIG. 7 is a vertical cross-sectional view showing a female connector housing of a second embodiment of a connector-shaking prevention structure of the present invention.
Figure 8:
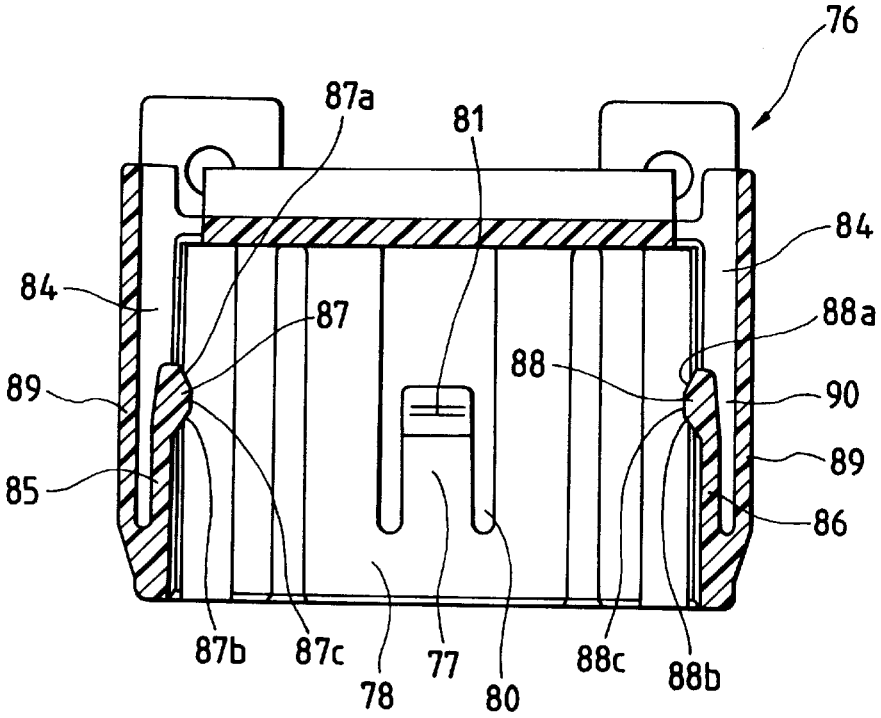
FIG. 8 is a horizontal cross-sectional view of the female connector housing.
Figure 9:
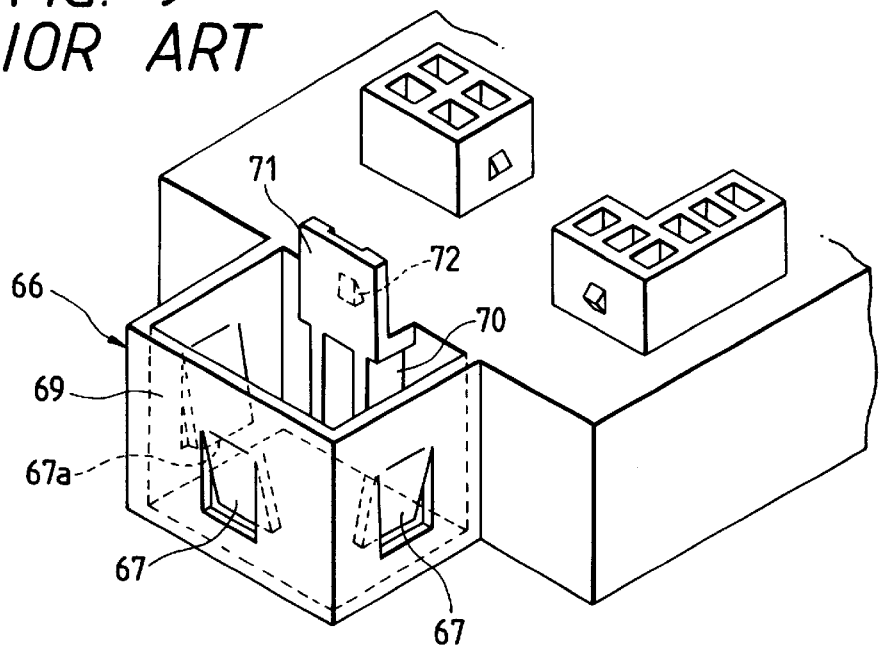
FIG. 9 PRIOR ART
FIG. 9 is a perspective view showing a conventional construction.
Figure 10:
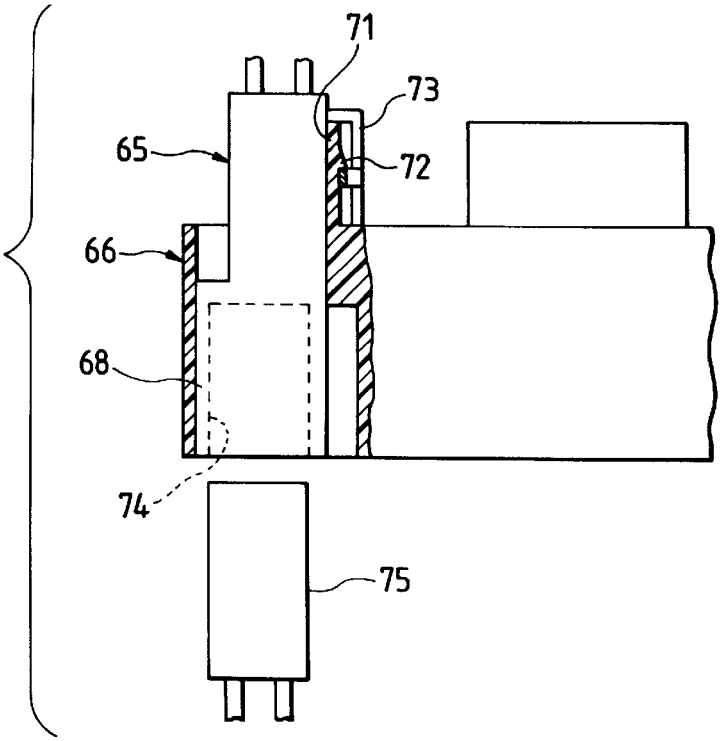
FIG. 10 PRIOR ART
FIG. 10 is a partly cross-sectional view of the conventional construction.

FIGS. 7 and 8 show a second embodiment of a connector-shaking prevention structure of the present invention.

This structure is characterized in that a first arm (hereinafter referred to as "arm") 77 is formed on a female connector housing 76, and projects in a connector disengaging direction. The other construction is generally the same as that of the first embodiment, and therefore detailed description thereof will be omitted. The connector housing 76 and terminals (not shown) jointly form a female connector.

As shown in FIG. 7, slits 80 (FIG. 8) are formed in a lower wall 79 of a connector fitting chamber 78 of the connector housing 76, thereby forming the arm 77. The arm 77 extends straight rearwardly from that portion of the lower wall 79 disposed adjacent to an inlet 78*a* of the connector fitting chamber 78. A projection 81 is formed at a distal end of the arm 77 which is disposed generally centrally of the length of the connector fitting chamber 78. This projection 81 projects into the connector fitting chamber 78. An upper surface 77*a* of the arm 77 is disposed flush with an inner surface 96 of the wall 79, and a lower surface 77*b* of the arm 77 is disposed parallel to the upper surface 77*a* of the arm 77.

As in the preceding embodiment, the projection 81 has a mountain-like shape, and has slanting surfaces 81*a* and 81*b*, formed respectively at its front and rear sides, and also has an apex portion 81*c* of a curved shape (arcuate shape) formed between the slanting surfaces 81*a* and 81*b*. A lower surface 81*d* of the projection 81 is slanting, and extends to the lower surface of the arm 77. An arm flexure space 83 is formed between the arm 77 and an outer wall portion 82, and the amount of flexing (displacement) of the projection 81 is increased because of the provision of the slanting lower surface 81*d*, and the projection 81 can be flexed also at its proximal end. Although a male connector, having a recess for receiving the projection 81, is not shown, it is generally similar to that of the preceding embodiment.

As shown in FIG. 8, second and third arms 85 and 86, similar to those of the preceding embodiment, are formed respectively on opposite side walls 84 and 84 of the connector fitting chamber 78 of the connector housing 76. Like the first arm 77, the second and third arms 85 and 86 extend in the connector disengaging direction, and the proximal ends of the first, second and third arms 77, 85 and 86 are not offset from one another in the forward-rearward direction (connector fitting and disconnecting directions), but are disposed generally in a common plane perpendicular to the forward-rearward direction. Similarly, the apex portions of the projections 81, 87 and 88 of the first, second and third arms 77, 85 and 86 are disposed generally in a common plane perpendicular to the forward-rearward direction.

The second and third arms 85 and 86 are disposed flush with the opposite side walls 84 of the connector housing 76, respectively, and the projections 87 and 88 project respectively from the inner surfaces of the opposite side walls 84 into the connector fitting chamber 78. The projection 87 has front and rear slanting surfaces 87*a* and 87*b* and the apex surface 87*c*, and the projection 88 has front and rear slanting surfaces 88*a* and 88*b* and the apex surface 88*c*. The first arm 77 is disposed midway between the second and third arms 85 and 86. Outer walls 89 are disposed outwardly of the second and third arms 85 and 86, respectively, and an arm flexure space 90 is formed between each of the arms 85 and 86 and the corresponding outer wall 89.

As shown in FIG. 7, insertion holes 92 for respectively press-fitting the male terminals (not shown) thereinto, as well as a molding hole 93 for molding the integral projection 81 of the arm 77, are formed through a proximal end wall 91 of the connector fitting chamber 78, and the male terminals (not shown) are press-fitted into these insertion holes 92, respectively. A lock wall portion (lock mechanism) 95 for engagement with a lock arm of a mating male connector (not shown) is formed on an upper wall 94 in opposed relation to the arm 77. The operation and effects of this embodiment are similar to those of the first embodiment, and therefore explanation thereof will be omitted.

In the above embodiments, the arm 2, 77 is formed on the female connector housing 7, 76, and the recess 5 . . . for receiving the projection 3, 81 of the arm 2, 77 is formed in the male connector housing 22 . . . (not shown in the second embodiment). However, an arm (not shown) can be formed on the lower outer wall 45 or the wall 48 of the male connector housing 22 . . . while a recess (not shown) can be formed in the wall portion 11, 82 of the female connector housing 7, 76. In this case, the arm is disposed parallel to the outer wall 45 of the male connector housing 22 . . . , and the projection is directed outwardly. Furthermore, the female connector 1 . . . can be mounted on the equipment in an upwardly-directed manner, that is, vertically so that the male connector 4 . . . can be fitted in and disengaged from the female connector 1 in the upward-downward direction. The shaking prevention structures of the above embodiments can also be applied to the type of connector, not provided with the front holder 41 and the spacer 44, and the type of connector not to be mounted directly on an equipment.

As described above, in the present invention, the projection of the arm, formed on one connector, is engaged in the recess in the other connector without shaking movement in the connector fitting and disengaging directions, and therefore a relative shaking movement between the two connectors in the connector fitting and disengaging directions is prevented, and therefore disadvantages, such as the production of abnormal noises, wear of the terminals and wear of the housings, are eliminated.

In the present invention, the projection and the recess portion contact each other at their front and rear slanting surfaces, and therefore the projection is snugly fitted in this recess, so that the relative shaking movement between the two connectors is more positively suppressed. And besides, when disengaging the two connectors from each other, the slanting surfaces of the projection and the recess smoothly slide relative to each other, so that the projection can be easily disengaged from the recess, thus facilitating the connector disengaging operation. In the present invention, after the two connectors are completely fitted together, the arm is not flexed (elastically-deformed), and therefore any stress acts on the arm in the direction of flexing of the arm. Therefore, in contrast with the conventional construction, the arm will not be subjected to permanent deformation, so that the shaking prevention force can be exerted in a stable manner for a prolonged period of time. In the present invention, when fitting the other connector into the connector fitting chamber in the one connector, the arm is flexed outwardly with its projection held in sliding contact with the outer wall of the other connector, and therefore the arm will not interfere with the fitting operation for the other connector, and therefore the connector fitting operation can be effected positively. And besides, the arm extends straight along the connector fitting chamber, and therefore after the male and female connectors are fitted together, the amount of flexing of the arm, that is, a play of the arm in the connector fitting and disengaging directions, is zero, so that the shaking movement in the connector fitting and disengaging directions is positively suppressed. The arm is disposed flush with the inner surface of the connector fitting chamber, and therefore as described above, after the male and female connectors are fitted together, the amount of flexing of the arm, that is, a play of the arm in the connector fitting and disengaging directions, is zero, so that the shaking movement in the connector fitting and disengaging directions is positively suppressed.

In the present invention, the other connector is held in the one connector between the arm and the lock mechanism, and therefore a shaking movement in the direction perpendicular to the connector fitting direction is also prevented. In the present invention, the other connector is also held in the one connector between the second and third arms against movement in a direction perpendicular to the direction of arrangement of the arm and the lock mechanism, and therefore the shaking movement in the upward-downward direction and the right-left direction is prevented. In the present invention, when the two connectors are completely fitted together, the flexing of the second and third arms is suppressed, so that permanent deformation of these arms is prevented as described above for the first arm.

What is claimed is:

1. A connector, comprising:

a first connector housing;

a second connector housing fittable to the first connector housing;

an elastic arm formed in the first connector housing so as to extend along a substantially fitting direction of the first and second connector housings, the elastic arm having a shaking prevention projection which is formed on a front end of the elastic arm, and has front and rear surfaces; and a recess formed in the second connector housing, and having front and rear inner surfaces, said front and rear inner surfaces having a same inclination angle as that of said front and rear surfaces of said shaking prevention projection, wherein when the first and second connector housings are completely fitted together, the shaking prevention projection is engaged in the recess so that the front and rear surfaces of the shaking prevention projection are held in intimate contact with the front and rear inner surfaces of the recess, respectively.

2. The connector of claim 1, wherein the front and rear inner surfaces of the recess, and the front and rear surfaces of the shaking prevention projection, are slanting surfaces.

3. The connector of claim 1, wherein when the shaking prevention projection is engaged in the recess, elastic deformation of the elastic arm is canceled.

4. The connector of claim 2, wherein when the shaking prevention projection is engaged in the recess, elastic deformation of the elastic arm is canceled.

5. The connector of claim 1, wherein the elastic arm has a surface extending straight along a connector fitting chamber which is formed in the first connector housing, and into which the second connector housing is insertable, and the recess is formed in an outer wall of the second connector housing.

6. The connector of claim 2, wherein the elastic arm has a surface extending straight along a connector fitting chamber which is formed in the first connector housing, and into which the second connector housing is insertable, and the recess is formed in an outer wall of the second connector housing.

7. The connector of claim 3, wherein the elastic arm has a surface extending straight along a connector fitting chamber which is formed in the first connector housing, and into which the second connector housing is insertable, and the recess is formed in an outer wall of the second connector housing.

8. The connector of claim 4, wherein the elastic arm has a surface extending straight along a connector fitting chamber which is formed in the first connector housing, and into which the second connector housing is insertable, and the recess is formed in an outer wall of the second connector housing.

9. The connector of claim 5, wherein the surface of the elastic arm is flush with at least one of inner surfaces of the connector fitting chamber, and the shaking prevention projection projects beyond a level of the at least one of inner surfaces into the connector fitting chamber.

10. The connector of claim 6, wherein the surface of the elastic arm is flush with at least one of inner surfaces of the connector fitting chamber, and the shaking prevention projection projects beyond a level of the at least one of inner surfaces into the connector fitting chamber.

11. The connector of claim 7, wherein the surface of the elastic arm is flush with at least one of inner surfaces of the connector fitting chamber, and the shaking prevention projection projects beyond a level of the at least one of inner surfaces into the connector fitting chamber.

12. The connector of claim 8, wherein the surface of the elastic arm is flush with at least one of inner surfaces of the connector fitting chamber, and the shaking prevention projection projects beyond a level of the at least one of inner surfaces into the connector fitting chamber.

13. The connector of claim 1, further comprising second and third shaking prevention arms which are provided 90° out of phase with the elastic arm in opposite directions.

14. The connector of claim 13, wherein the second and third shaking prevention arms have surfaces which are respectively flush with surfaces of opposite side outer walls of the first connector housing, and projections respectively formed on the second and third arms so as to project in a connector fitting chamber which is formed in the first connector housing, and into which the second connector housing is insertable.

15. The connector of claim 1, wherein said front and rear inner surfaces of said recess and said front and rear surfaces of said shaking prevention projection are planar.

* * * * *